United States Patent [19]

Wilkins

[11] 4,450,887

[45] May 29, 1984

[54] DIRECT CHILL CASTING APPARATUS

[75] Inventor: Rennie F. T. Wilkins, Chigwell, England

[73] Assignee: The British Aluminium Company Limited, England

[21] Appl. No.: 326,307

[22] Filed: Dec. 1, 1981

Related U.S. Application Data

[62] Division of Ser. No. 12,765, Feb. 16, 1979, Pat. No. 4,355,679.

[30] Foreign Application Priority Data

Feb. 18, 1978 [GB] United Kingdom ..... 6527/78

[51] Int. Cl.[3] ..... B22D 11/04; B22D 11/16

[52] U.S. Cl. ..... 164/154; 164/155; 164/414; 164/436; 164/437; 164/444

[58] Field of Search ..... 164/444, 436, 415, 149, 164/418, 472, 437, 154, 155, 414

[56] References Cited

U.S. PATENT DOCUMENTS

| | | | |
|---|---|---|---|
| 2,672,665 | 3/1954 | Gardner et al. | 164/418 X |
| 3,326,270 | 6/1967 | Collins et al. | 164/418 X |
| 3,630,266 | 12/1971 | Watts | 164/490 X |
| 4,016,924 | 4/1977 | Maier | 164/489 |
| 4,157,728 | 6/1979 | Mitamura et al. | 164/487 X |

FOREIGN PATENT DOCUMENTS

| | | | |
|---|---|---|---|
| 519175 | 12/1955 | Canada | 164/437 |
| 2105881 | 8/1972 | Fed. Rep. of Germany | 164/437 |
| 47-24338 | 7/1972 | Japan | 164/478 |
| 1110553 | 4/1968 | United Kingdom . | |
| 431954 | 11/1974 | U.S.S.R. | 164/444 |

*Primary Examiner*—Gus T. Hampilos
*Assistant Examiner*—J. Reed Batten, Jr.
*Attorney, Agent, or Firm*—Karl W. Flocks; A. Fred Starobin; Sheridan Neimark

[57] ABSTRACT

Method and apparatus for the direct chill casting of non-ferrous metals comprises varying the chill depth of the mould independently of the level or quantity of liquid metal in the mould by relatively moving the mould and a "hot-top" which may be a sleeve of refractory material during the casting, which may comprise semi-automatic or automatic casting.

14 Claims, 14 Drawing Figures

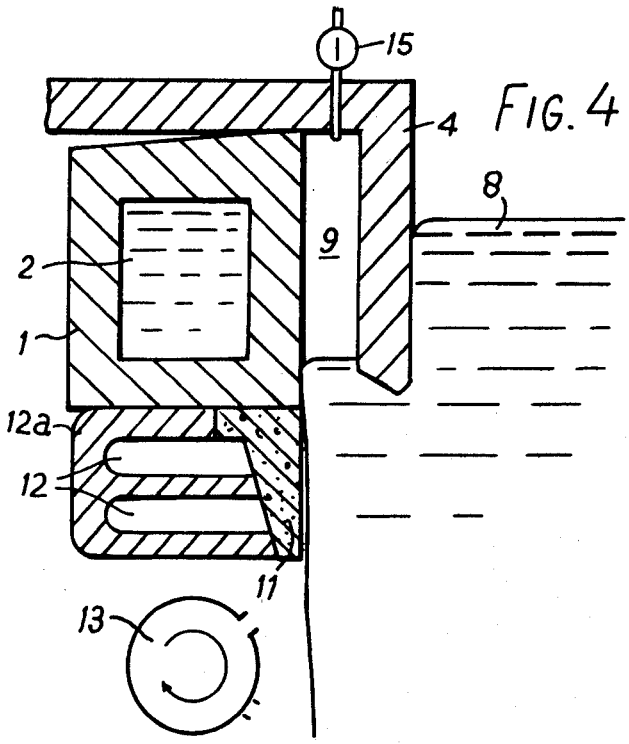
FIG. 4
FIG. 5a
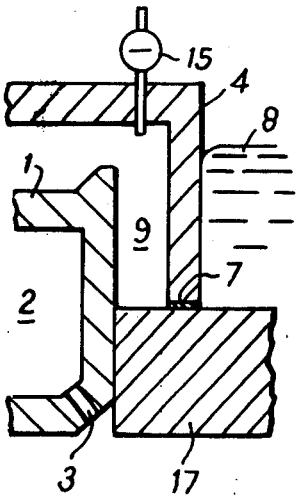
FIG. 5b
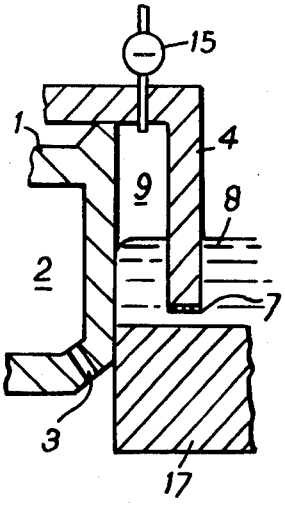
FIG. 5c
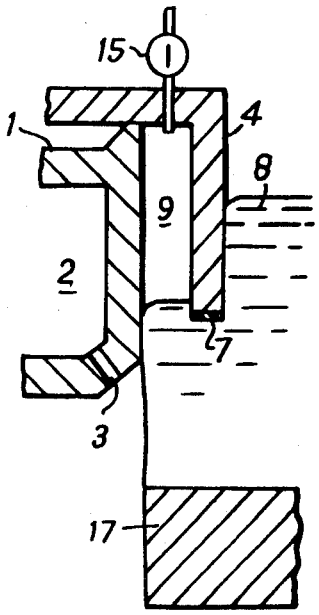

LENGTH OF MOULD EXPOSED TO LIQUID METAL (cm)
10
9
8
7
6
5
4
3
2
1
0
2
4
6
8
10
12
14
16
A
RAM SPEED (cm/min)

DIRECT CHILL CASTING APPARATUS

This is a division of application Ser. No. 012,765, filed Feb. 16, 1979, and now U.S. Pat. No. 4,355,679, issued Oct. 26, 1982.

BACKGROUND OF THE INVENTION

This invention relates to the direct chill casting of non-ferrous metals and particularly although not exclusively to the direct chill casting of aluminium and aluminium base alloys.

In the direct chill casting of aluminium and aluminium base alloys blemishes of various kinds are frequently encountered on the surface of the castings, for example bleed bands in rolling slab and folds and cold shuts in billet. These defects have necessitated scalping the surfaces of the casting sometimes to a considerable depth before a subsequent rolling operation. It has been known for many years that the incidence of these defects can be greatly reduced by maintaining a low level of metal in the mould, but this brings with it operating problems which are particularly acute at the commencement of the cast.

It has been proposed in British Pat. No. 1,026,399 to reduce these problems by providing a flexible insulating liner to the upper part of the mould so that liquid metal is protected from the chilling action of that part of the mould wall which is covered with the insulating liner, and the effective depth of metal in the mould is reduced to that of the lower, bare section. Whilst by using this procedure a marked improvement to the surface finish of the casting can be obtained, problems relating to the start of the casting process still persist. Also the liner readily becomes damaged and needs frequent replacement.

It has also been proposed in the Isocast (Registered Trade Mark) system to overcome the starting difficulties associated with operating at a low metal depth by means of a moving casting table, the casting table being raised during the course of casting whereby the metal depth in the mould is progressively reduced. A disadvantage with this system is the need for expensive equipment involving precise movement of the casting table, coupled with considerable dependence on operator skill in use.

It has also been proposed to provide very precise control over the metal level in the mould, in order to achieve control of the mould chill depth, by programmed control of metal flow from a tilting furnace and very precise control both of liquid metal flow along a launder to the casting head and of metal level in the mould. Such systems are essentially ones of low intrinsic heat content and are accordingly sensitive to transient small fluctuations in the major process parameters so that close control over the minor process variables is necessary. Most importantly however the system is not applicable to level pour casting since very low levels of liquid metal are required in the mould and it then becomes difficult to supply liquid metal below the surface of the pool of metal in the mould so that an inherent restriction is placed upon cast metal quality.

It is accordingly an object of the present invention to provide an improved method and apparatus for the direct chill casting of non-ferrous metals which materially reduces defects on the surface of the castings so minimising and in some cases obviating the necessity for scalping: which makes use of physically robust apparatus that is comparatively inexpensive to install and which can be adapted for a level pour process. It is also an object of the present invention to provide semi-automatic and automatic control for such casting method and apparatus.

BRIEF SUMMARY OF INVENTION

According to one aspect of the present invention there is provided a method for the direct chill casting of non-ferrous metals through an open mould characterised in that during the casting operation the axial length of that part of the mould in contact with liquid metal is varied independently of variations of the level of liquid metal in the mould.

Another aspect of the present invention provides a method for the direct chill casting of non-ferrous metals through an open mould characterised by relatively moving axially the mould and a rigid sleeve of thermally insulating material within the mould during casting of the metal in the sense to increase an overlap between the mould and the sleeve and in the direction of metal flow after the casting operation has commenced.

The invention also provides a method for the direct chill casting of non-ferrous metals through an open mould characterised by disposing a rigid thermally insulating sleeve partially within and in clearance relationship with the inner upstream surface of the mould prior to commencement of casting the metal and characterised by moving the sleeve and the mould axially relative to one another after casting of the metal has commenced so that the sleeve extends further into the mould.

A further aspect of the invention provides a method for the direct chill casting of non-ferrous metals vertically through a water cooled open mould and applying cooling water to the emergent casting characterised by disposing a rigid thermally insulating sleeve partially within and in clearance relationship with the inner surface of the upper part of the mould prior to the commencement of casting the metal and characterised by lowering the sleeve axially further into the mould after casting of the metal has commenced.

Yet another aspect of the invention provides a method for the vertical direct chill casting of non-ferrous metals through an open mould characterised by disposing a rigid sleeve of thermally insulating material within upstream end of the mould and in spaced relationship to the mould wall so that liquid metal may enter the annular gap between the mould and the sleeve and applying gas under pressure to the upper end of said gap to vary the axial length of that part of the mould in contact with liquid metal after the casting operation has commenced.

Another aspect of the invention provides a method of vertical direct chill casting of non-ferrous metals and metal alloys using an open mould by automatically varying the axial length of that part of the mould in contact with liquid metal during the casting operation in relation to the casting speed.

The invention also provides apparatus for the direct chill casting of non-ferrous metals through an open mould characterised by a rigid sleeve of thermally insulating material of a size and shape to be a clearance fit within the mould and located in register with the upstream end of the mould and means for relatively moving the mould and the sleeve to vary the axial length of the mould overlapped by the sleeve.

In another aspect the invention provides apparatus for the direct chill casting of non-ferrous metals through an open mould characterised in that a rigid thermally insulating sleeve is disposed partially within and in clearance relationship with the inner surface of the upstream end of the mould and means for moving the sleeve and the mould axially relative to one another.

A further aspect of the invention provides apparatus for the direct chill casting of non-ferrous metals comprising a water cooled open mould having its axis vertical and means below the mould for applying cooling water to the emergent casting characterised in that a rigid thermally insulating sleeve is disposed partially within and in clearance relationship with the inner surface of the upper part of the mould and means for lowering the sleeve further into and out of the mould.

A yet further aspect of the present invention provides apparatus for the direct chill casting of non-ferrous metals through an open mould characterised by a rigid sleeve of thermally insulating material of a size and shape to be a clearance fit within the mould and disposed in overlapping relationship with the mould from the upstream end thereof, an annular porous diaphragm disposed below and in register with the mould and means for supplying gas under pressure through the diaphragm to support the emergent casting, means for sealing the upstream part of the gap between the sleeve and the mould and means for supplying gas under pressure to the gap.

BRIEF DESCRIPTION OF DRAWINGS

The above and other aspects of the invention will now be described by way of example with reference to the accompanying drawings in which:

FIG. 4 is a view generally combining the structures of FIGS. 2 and 3*a*, 3*b* and 3*c*, and FIG. 5*a*, FIG. 5*b* and FIG. 5*c* show further modifications of the arrangement of FIGS. 3*a*, 3*b* and 3*c*.

DETAILED DESCRIPTION OF INVENTION

Figure 1A:
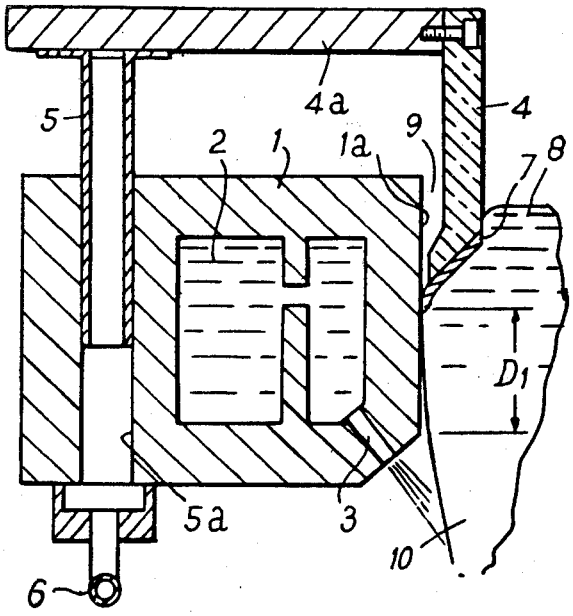
FIGS. 1*a* and 1*b* show diagrammatically in vertical section part of one form of apparatus according to the present invention for the vertical direct chill casting of non-ferrous metals and respectively showing an insulating, movable sleeve in different positions.

Referring to FIG. 1*a* the apparatus comprises an open ended (i.e. annular) metal mould, 1, having an integral water channel 2, from which cooling water escapes on to an emerging casting through holes, 3. An annular rigid insulating sleeve, 4, is carried on a ring, 4*a* supported on the upper ends of hollow pistons such as 5 movable in cylinders such as 5*a* formed in the mould 1. Thus the sleeve 4 can readily be moved up or down within the mould by application of air under pressure to the chamber 5*a* through pipes such as 6. The sleeve 4 is of refractory fibres of, for example aluminium silicate, rigidised in known manner and readily commercially available; its lower end is tapered to an angle of about 45° and has fixed to it a strip 7, of material such as Fiberfrax (Registered Trade Mark), to be in sliding contact with the inner surface 1*a* of the mould in order to prevent liquid metal rising up between the mould and the sleeve. Alternatively plaited strands of carbon fibre material could be located in an external groove (not shown) in the sleeve to rub against the mould wall. In operation, the sleeve 4 is raised as in FIG. 1*a* to expose a considerable length of mould $D_1$, to the liquid metal for convenience in starting the cast. Liquid metal is fed into the mould cavity, 8, through a downspout (not shown) or a level pour arrangement may be used. After the establishment of metal flow, the sleeve, 4, is lowered to the position shown in FIG. 1*b* as a result of which the length of metal mould exposed to the liquid metal is reduced to $D_2$. FIG. 1*c* shows a modified cross-sectional shape for the sleeve 4, in which its lower end is shaped so as to follow approximately the curve of the meniscus of liquid metal near the inner periphery of the mould. The outer surface of the sleeve is also tapered so that the clearance between the sleeve and the mould is greatest at the top of the mould. Lubricant can be fed into the gap, 9, between the sleeve, 4, and the mould by any known means (not shown) for example by oil grooves. On emerging from the mould cavity, 8, a casting, 10, is cooled directly by water passing through the holes, 3, from the water channel, 2. The casting 10 may be further cooled in known manner by water applied thereto by means (not shown) below the level of the mould. Although it is preferred that the sleeve, 4, project into the mould before casting is commenced this need not be so and it could be moved into the mould from a starting position wholly externally thereof. $D_1$ may conveniently be up to 10 cm and $D_2$ may be up to 5 cm but is preferably between 2 and 3 cm although for fast casting of certain alloys $D_2$ may be less than 6 mm.

Figure 2:
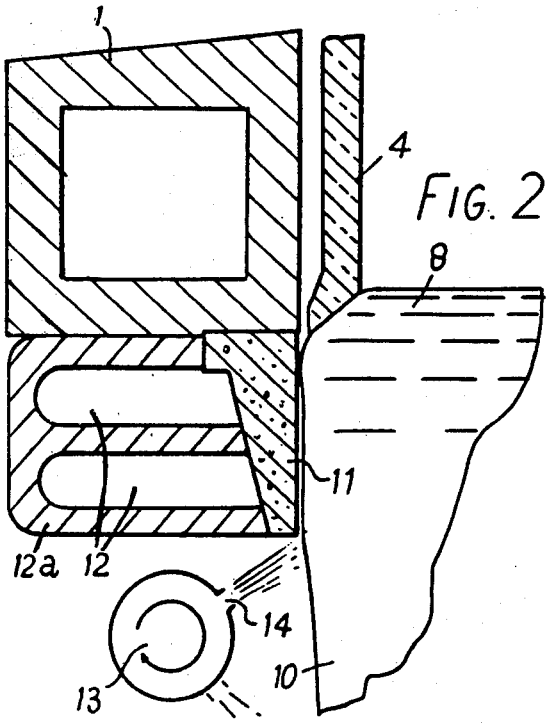
FIG. 2 shows a similar view of a modified construction.

Although it is envisaged above that the sleeve is lowered to its optimum operating position during casting and then remains in this position it will be understood that there may be practical circumstances during casting which necessitate that further movement of the sleeve up or down is desirable. This is particularly likely if movement of the sleeve is automatically controlled in response to the feedback of information relating to the nature of the emergent casting when some hunting of the sleeve may be expected. The sleeve may be lowered into the mould progressively or it may be moved quickly in a single step from its upper to its lower position. In the latter case, it is desirable to lower the position at which cooling water is first applied to the casting by an amount related to the extent of movement of the sleeve. In FIG. 2 the metal mould, 1, does not contain holes for supplying cooling water to the emerging casting. The sleeve, 4, is shown lowered to such a position that the effective length of the mould is essentially nil and the metal head is supported laterally by air under pressure applied through an annular permeable membrane, 11, from air channels, 12, in a support 12*a* for the membrane. A rotatable water tube, 13, is used to apply water directly to the emerging casting, 10, through jets 14 in its wall. The tube, 13, can be rotated so that the direction of the water jets 14 can be adjusted as desired, for example lowered from an upper to a lower position as the sleeve, 4, is lowered. At the start of the casting operation, it is desirable that at least 3 cm of chilled mould is exposed to the liquid metal and if the sleeve is lowered only so far as to leave some of the mould exposed, this exposed length should not exceed 1 cm. Nitrogen, argon, carbon dioxide or other gas less reactive to Al than air may be used to provide lateral support for the casting.

Figure 3A:
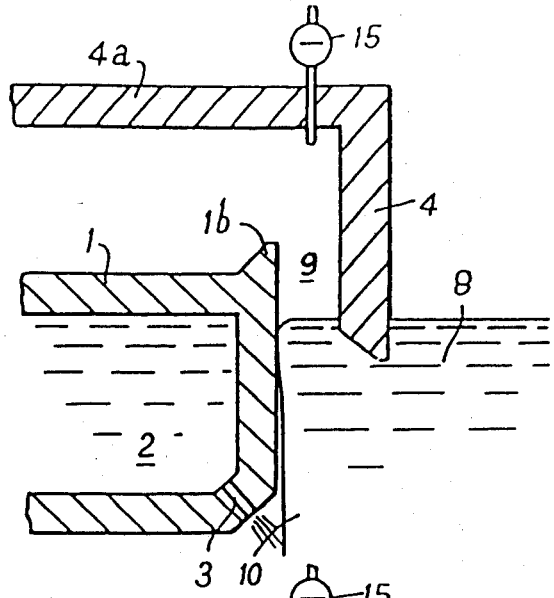
FIG. 3*a*, FIG. 3*b*, and FIG. 3*c* show similar views of a differently modified construction generally corresponding to the views shown in FIGS. 1*a*, 1*b* and 1*c*.
Figure 3B:
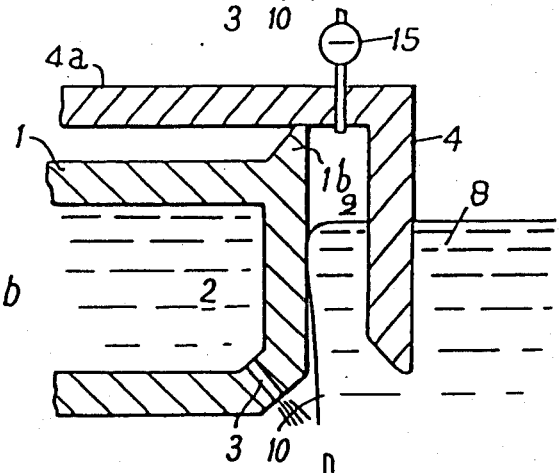
Figure 3C:
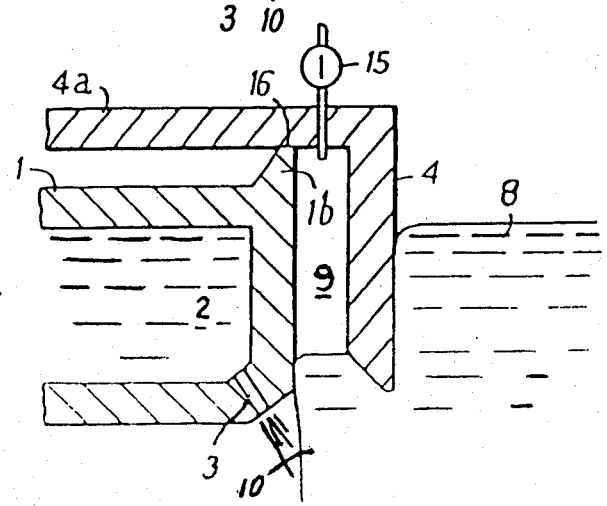

FIGS. 3*a*, 3*b* and 3*c* illustrate the use of compressed air (as for example nitrogen or argon) in order to control the effective metal depth in the mould at a low level after casting has been established. The sleeve, 4 and ring 4*a* incorporate a pipe and valve, 15, to which a supply of compressed air is attached. In operation the movable insulating sleeve is initially in the high position shown in FIG. 3*a*. After casting has been established, the sleeve, 4, is lowered into the operating position, FIG. 3*b*, after which compressed air is passed through the pipe and valve, 15, until the metal in the gap, 9, has reached the desired level for optimum casting quality as shown in FIG. 3*c*. Air is prevented from escaping from the gap, 9, by a low pressure seal, 16, formed by an upper part 1*b* of the mould 1. The gap 9 may be at least 1 cm wide and is preferably at least 2 cm wide. Furthermore holes (not shown) may be formed in the lower part of the sleeve to assist passage of liquid metal into the gap 9. A pressure release device may be incorporated in the valve 15 to prevent over pressurising the metal in the gap 9.

In FIG. 4, the sleeve, 4, is shown in the low (operating) position, and compressed air has been applied to the gap, 9, so as to lower the metal level to the desired degree. Lateral support is provided to the emerging metal by application of compressed air from the ducts, 12, through permeable material, 11. Water is supplied to the metal, as it emerges from within the ring of permeable material, by means of the adjustable spray ring, 13 having jets 14.

Figure 1B:
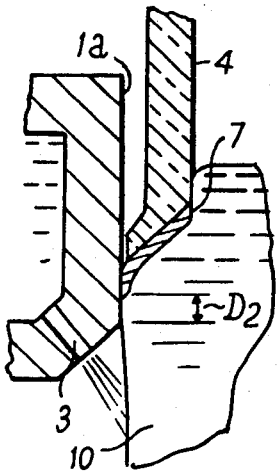
Figure 1C:
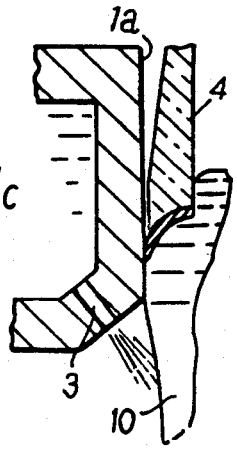
FIG. 1*c* shows a modified arrangement in the position of FIG. 1*b*.

In one example of the process carried out in accordance with the present invention, a mould assembly of the kind shown in FIGS. 1*a*, 1*b* and 1*c* was set up in order to cast rolling block of 50 cm×17.5 cm section in commercially pure aluminium. Casting was begun with the insulating sleeve, 4, in such a position as to give 3.75 cm length of mould, 1, exposed to the liquid metal. The surface of the cast metal exhibited conspicuous bleed bands with a spacing of approximately 2.5 cm. The insulating sleeve was then lowered so as to give an exposed mould length of 2.2 cm. The cast surface then became very good, the bleed bands being completely suppressed. The good cast surface continued until the drop was terminated, except for one short length during the casting of which the insulating sleeve was intentionally returned to the high position for 2 minutes whereupon bleed bands were again produced. The length of block cast was 280 cm.

In a further experiment air pressure of 75 cm water gauge in conjunction with a bleed valve was used to push down the liquid metal in the gap, 9, whereupon the metal level in the main portion of the mould cavity rose by approximately 1.2 cm in one test and 5 cm in a second, confirming that the metal level in the annular space had been lowered by the desired amount of 1.2 cm and 5 cm the relative cross-sectional areas of the annular space and the main mould cavity being in the approximate ratio of 1:1. The mould diameter was 26.25 cm.

With certain alloys, in particular the strong heat treatable compositions, casting problems often arise because of the cracking tendency to which such alloys are subject. These problems are most severe near the start of the cast. In such cases it may be preferable to modify the shape of the insulating sleeve shown in FIGS. 3*a*, 3*b*, and 3*c* in the manner shown in FIG. 5*a* so that it can fit against a conventional starter block, 17, a strip of Fiberfrax (Registered Trade Mark) or similar fibrous refractory material at the lower end of the sleeve then forming a metal-tight seal. When casting these difficult alloys, the starter block, 17, may be raised within the mould and the insulating sleeve, 4, lowered to such an extent that a metal-tight seal is formed as shown in FIG. 5*a*. Metal is then fed into the cavity, 8, formed by the insulating sleeve and the starter block, but is prevented from coming in contact with the water-cooled mould, 1, because of the metal-tight seal formed by the strip 7. When the metal level within the insulating sleeve has reached the desired value, lowering of the starter block and the sleeve is begun and liquid metal flows into the annular gap, 9, as shown in FIG. 5*b*. It is then a simple matter, by applying compressed air through the pipe, 15, to lower the metal level in the gap, 9 to the optimum value for good surface quality as shown in FIG. 5*c*. In this manner the cracking trouble in casting strong alloys can be reduced, since the mould cavity can be prefilled with metal to the desired depth before it comes into contact with the water-cooled mould, thus eliminating one of the principal causes of the trouble.

It will also be understood that with the arrangements of FIGS. 4 and 5*a*, 5*b* and 5*c* a fixed sleeve could be provided located in the desired lowermost position and the axial length of that part of the mould in contact with liquid metal could be controlled entirely by gas pressure in the gap between the sleeve and the mould. When gas under pressure is used to control the liquid metal level in the gap 9 the latter is preferably between 1 cm and 3 cm wide.

With all the arrangements above described it will be understood that the sleeve may be stationary and means can be provided for raising and lowering the mould. However, as described in relation to FIGS. 1*a*, 1*b* and 1*c*, it is preferable to support the sleeve by the pistons of pneumatically controlled piston and cylinder motors and it will be apparent that the sleeve will also be supported in part by its natural buoyancy in the pool of liquid metal at the upper part of the casting. Also the provision of the movable sleeve or the fixed sleeve with gas pressure enables the axial length of the mould in contact with liquid metal to be varied, during the casting operation, independently of variations in the level of liquid metal in the mould. Thus by controlling these parameters separately optimum start up conditions, optimum continuous casting conditions and optimum termination of the cast can be achieved.

During a vertical direct chill casting process the variables that need to be continuously controlled, apart from temperature, include metal flow rate, water flow rate, casting speed and metal level in the mould and the present invention, which permits these parameters to be varied independently of each other, is particularly suitable for inclusion in a semi-automatic or fully automatic system.

Figure 6:
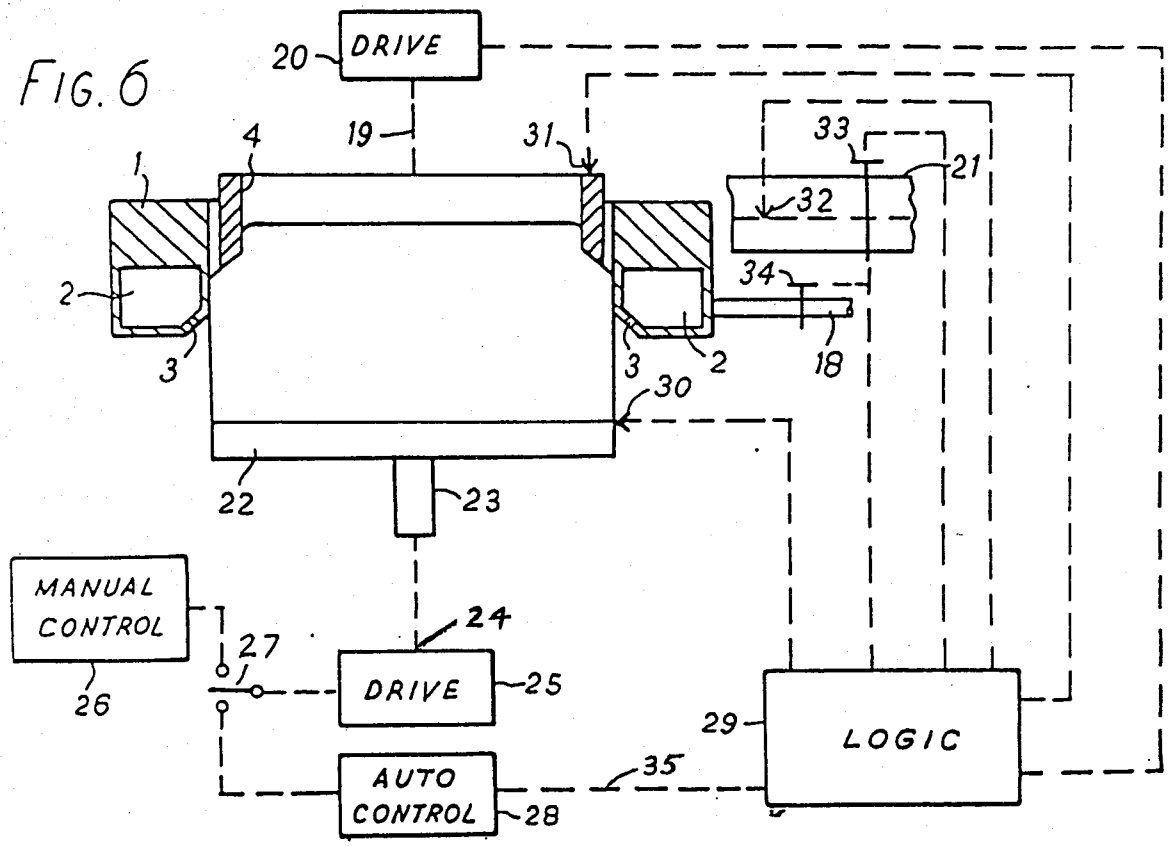
FIG. 6 shows diagrammatically an open mould with a movable ram and a movable sleeve and control apparatus for effecting semi-automatic or automatic casting.

Such a system is shown diagrammatically in FIG. 6 where an open mould 1 having an integral water channel 2 with discharge apertures 3 is supplied with cooling water through a pipe 18. A movable sleeve 4 is arranged for vertical movement into and out of the mould 1 and is connected at 19 with drive mechanism 20 which may, for example be an electrically operable, hydraulically damped pneumatic system. A liquid metal supply launder 21 is disposed externally of the mould at a height to provide metal to the mould by "level pour" using means not shown. A casting support 22 is mounted on a moving ram 23 connected at 24 with a drive mechanism 25. The latter may be an electrically powered screw but is preferably an electrically controlled hydraulic piston and cylinder motor. A manual control 26 for the mechanism 25 is coupled therewith via a two-way switch 27 and incorporates conventional start/stop/reverse and speed controls. Similar controls together with electrically powered drives therefor are provided in an automatic control 28 coupled to the mechanism 25 via the switch 27.

A logic device 29 incorporates a suitable microprocessor capable of being programmed to handle the desirable sequence stages with a number of inbuilt "fail safe" provisions. Information relating to the position of the ram 23, the position of the sleeve 4 (and therefore the axial length of the mould 1 contacted by liquid metal) and the level of liquid metal in the launder 21 is continuously provided to the device 29 respectively from position detectors 30 and 31 and a level detector 32, and operating signals are continuously provided from the device 29 to the drive mechanism 20, a metal flow control 33 in the launder 21, a water monitor and flow control 34 in the pipe 18 and the automatic control 28 (when used) for the drive mechanism 25.

Figure 7:
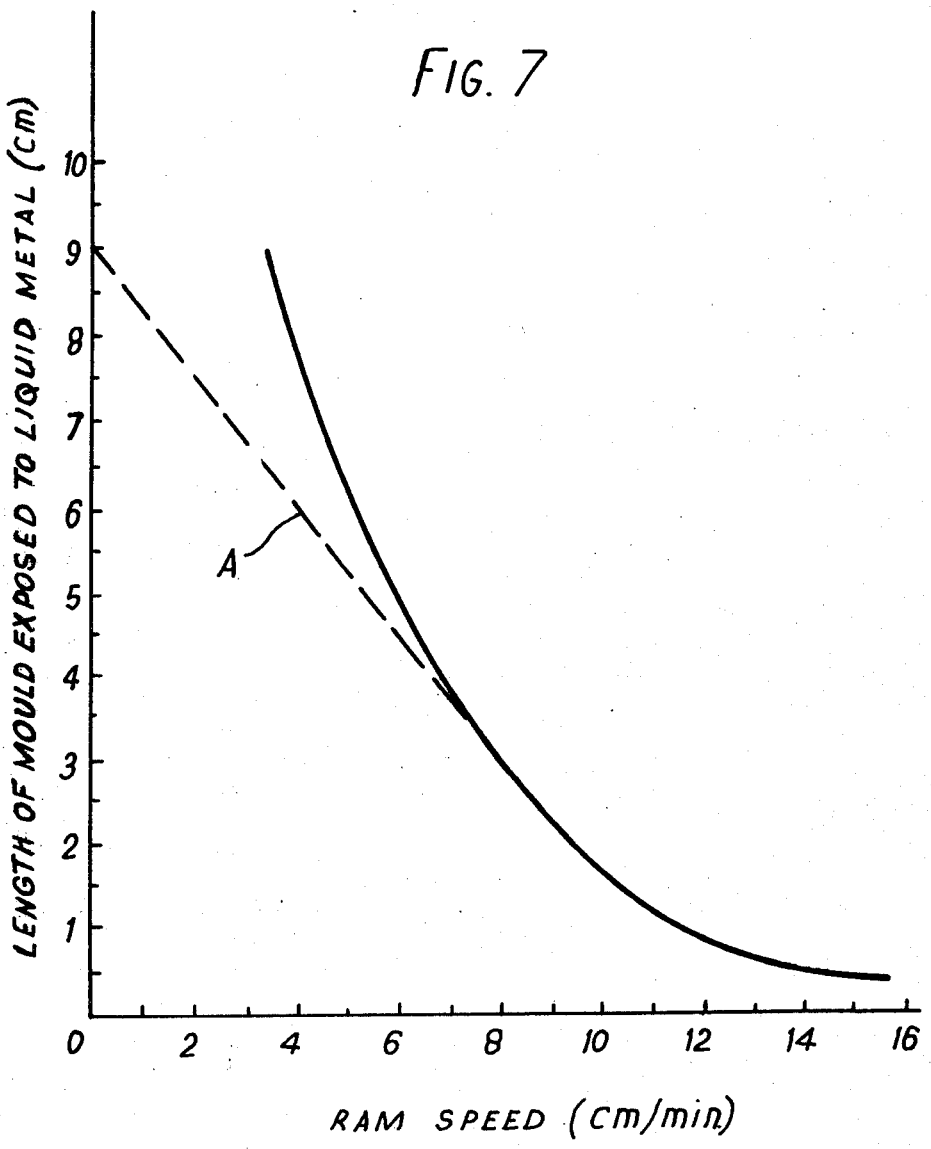
FIG. 7 is a graph showing the relationship between ram speed and chill depth.
Figure 8:
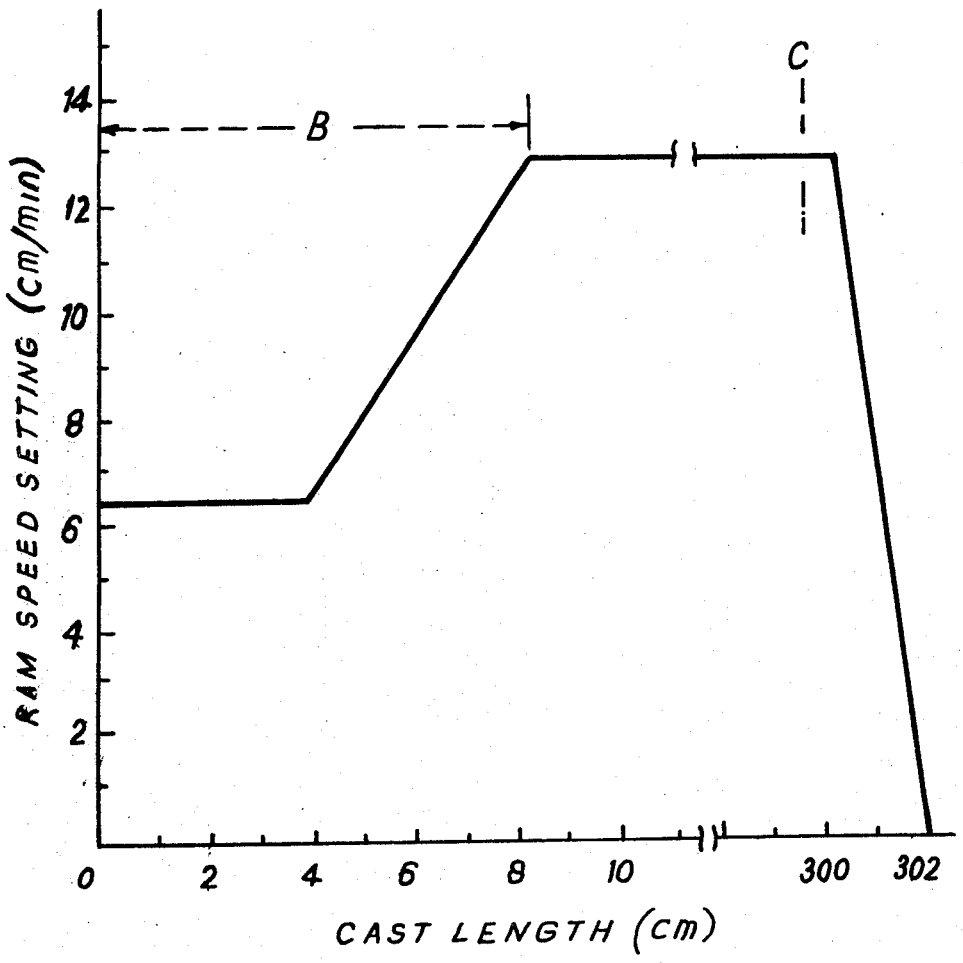
FIG. 8 is a graph showing variation of ram speed setting with cast length.

FIG. 7 is a graph showing the empirically determined relationship between the speed of the ram 23 and the length of the mould 1 exposed to liquid metal to achieve optimum casting conditions. The conditions shown give optimum block quality when casting 1200 alloy in rectangular moulds of 27 in × 10 in. For more highly alloyed compositions the relationship becomes displaced towards the origin, the amount of such small displacement being readily determined by experiment for each class of alloy. Thus with about 9 cms of mould exposed optimum conditions for a safe and easy start are achieved. For fast casting with the ram speed at about 16.7 cm/minute optimum casting conditions are achieved when about 0.5 mm of the lower part of the mould is exposed to liquid metal. It will be understood that the sleeve normally remains stationary until the ram speed has reached approximately 3.75 cm/minute. However, in practice, if a casting speed of less than about 10 cm/minute and an operating mould chilled length of less than about 2.5 cms are not required then the practical curve can follow the dotted line -A- and the sleeve would then start moving as the ram is lowered. FIG. 8 shows ram speed setting plotted against the length of the emerging cast ingot for the same casting operation as FIG. 7. The first part 'B' of the curve includes the initial acceleration period of ram movement. Towards the end of the steady state condition the point 'C' represents the position at which metal flow to the mould would be stopped and this position would be related to the total cast length and the residual liquid metal in the system. Water flow would be reduced after the point 'C' but would remain at a constant reduced level in order to further cool the cast ingot.

The curves of FIGS. 7 and 8 show that it is convenient to use the ram speed as the controlling parameter of a semi-automatic or automatic casting system. The chill depth and the water flow rate may also be varied in accordance with the ram speed. Thus in the semi-automatic mode of FIG. 6 ram speed would be controlled manually by the control 26 and the chill depth would be controlled by the logic device 29 to move the sleeve 4 in accordance with pre-programmed positions monitored by the position detector 31. At the same time metal flow and water flow would be varied by the controls 33 and 34 and the metal flow monitored by detector 32 in accordance with a predetermined programme. As illustrated in FIG. 8 it is convenient that the ram speed shall be varied according to a predetermined programme based upon the length of the emerging cast ingot and in the automatic mode of FIG. 6 the logic device 29 would provide signals via 35 to the automatic control 28 in accordance with the position at any time of the ram 23 as monitored by the detector 30. Since all the operating parameters except ram speed are continuously monitored and controlled by the logic device 29 during manual control then even if the latter is not exercised in the optimum manner for a particular cast, changing to the automatic mode will immediately make such variations in all the variables as will achieve optimum conditions. This enables switching between manual and automatic control to be carried out at will.

It will be understood that upon normal termination of casting the sleeve and the ram will be returned to their upper positions.

The logic device 29 will desirably incorporate failsafe provisions to accommodate excessive variations in water flow, interruption in metal flow and power failures and in particular would ensure that the sleeve is rapidly returned to its uppermost position should the upper part of the casting become over chilled.

By way of example, Tables I and II illustrate the manner in which the invention may be practised. Table I shows the ram speed settings to be followed when casting a 305 cm long rolling block of section 70 × 25 cm in 1200 alloy at 10 cm/minute, operation of the present invention being in the manual mode. The point at which metal flow is terminated in relation to the length of block to be cast will naturally depend on the volume of metal in the launder system used.

Table II indicates the procedure to be followed when the same block is being cast in accordance with the present invention employed in the automatic mode with level metal transfer. In this example the casting speed is 13 cm/minute.

TABLE I

| Length of cast (cm) | Ram speed setting (in/min) | Remarks |
|---|---|---|
| 0 | 6.4 | Start Ram |
| 3.3 | 6.4 | |
| ↓ | ↓ | |
| 5.7 | 10 | |
| 297 | 10 | Terminate metal |
| ↓ | ↓ | flow |
| 299 | 5 | |
| 302 | 0 | Stop Ram |

→ initiates a progressive change in ram speed

TABLE II

Press "start cast" button: metal flows into casting launder and into mould until metal level detection device in launder is triggered. Ram is then lowered in accordance with the following schedule.

| Length of cast (cm) | Ram speed setting (cm/mins) | Remarks |
|---|---|---|
| 0 | 6.4 | |
| 3.8 | 6.4 | Speed uniformly |
| ↓ | ↓ | raised from 6.4 |
| 8.25 | 13 | to 13.0 cm/min |
| 300 | 13 | Speed uniformly |

TABLE II-continued

| Press "start cast" button: metal flows into casting launder and into mould until metal level detection device in launder is triggered. Ram is then lowered in accordance with the following schedule. | | |
|---|---|---|
| Length of cast (cm) | Ram speed setting (cm/mins) | Remarks |
| ↓ | ↓ | lowered from |
| ↓ | ↓ | 13.0 to 6.4 cm/min |
| 302 | 0 | Ram stopped |

→ Block discharge routine is initiated.

Rolling block cast in 1200 alloy with the ram speed scheduling shown in Tables I and II and with corresponding exposed mould lengths related thereto in accordance with Table I have shown exceptionally good surface quality.

I claim:

1. Apparatus for the direct chill casting of non-ferrous metals comprising a water cooled open mould having its axis vertical, an inner surface of the mould, a rigid sleeve of thermally insulating material of a size and shape to be a clearance fit within the inner surface of the mould, support means for locating the sleeve in register with the upstream end of the inner surface, drive means operable during a casting operation for relatively axially moving the mould and the sleeve to vary the axial length of the inner surface overlapped by the sleeve, a gap between the sleeve and the inner surface, means for maintaining a pool of liquid metal within the mould during a casting operation with a peripheral zone of the pool in contact with the inner surface, and pressure means associated with the sleeve and operable during a casting operation to vary the downward pressure applied to the zone in order to vary the axial length of the inner surface contacted by liquid metal.

2. Apparatus according to claim 1 in which the drive means permits such relative movement to an extent that there is no overlap between the mould and the sleeve.

3. Apparatus according to claim 1 or claim 2 in which the gap is sufficiently small that liquid metal from the pool does not significantly penetrate therein and said pressure means comprises the lower end of the sleeve.

4. Apparatus according to claim 3 in which the lower end of the sleeve is tapered on its inward facing side at an angle of about 45°.

5. Apparatus according to claim 3 in which the outer surface of the sleeve is itself so tapered that the gap is greatest at the upstream end of the mould.

6. Apparatus according to claim 3 in which a strip of flexible refractory material is fixed on the lower end of the sleeve to be in rubbing contact with the inner surface.

7. Apparatus according to claim 3 in which at least one strip of carbon fibre material is carried externally of the sleeve to be in rubbing contact with the inner surface.

8. Apparatus according to claim 1 in which the width of the gap is sufficient to permit liquid metal from the pool to penetrate therein, means for sealing the upper part of the gap when the sleeve is in its lowermost position and the pressure means comprising gas under pressure is supplied to the gap to act upon the peripheral zone of the pool.

9. Apparatus according to claim 8 in which the width of the gap is between 1 cm. and 3 cm.

10. Apparatus according to claim 3 or claim 8 having a vertically movable casting support below the mould, means for moving the support upwardly towards the mould and downwardly therefrom, means for determining the axial length of the inner surface in contact with liquid metal at any time during a casting operation and means to control movement of the sleeve so as to vary said axial length in accordance with the downward speed of the casting support.

11. Apparatus according to claim 10 comprising means for supplying cooling water to a cast ingot below the mould and automatic means for separately varying the rates of flow of cooling water to the mould and to the cast ingot in accordance with the casting speed.

12. Apparatus according to claim 10 comprising automatic means for varying the rate of flow of liquid metal to the mould in accordance with the casting speed.

13. Apparatus according to claim 10 comprising automatic means for varying the casting speed in relation to the length of ingot already cast.

14. Apparatus according to claim 10 comprising a launder for delivering liquid metal to the mould by "level pour", means for detecting the level of liquid metal in the launder and means to initiate downward movement of the casting support from its uppermost position when the liquid metal in the launder reaches a predetermined level.

* * * * *